US007807089B2

(12) United States Patent
Godelmann, Jr.

(10) Patent No.: US 7,807,089 B2
(45) Date of Patent: Oct. 5, 2010

(54) METHOD AND MOLD FOR MANUFACTURING GROUND SLABS MADE OF CEMENT-BONDED MATERIAL OR CONCRETE

(75) Inventor: Bernhard Godelmann, Jr., Kümmersbruck (DE)

(73) Assignee: Godelmann Pflasterstein GmbH & Co. KG, Hogling (DE)

( * ) Notice: Subject to any disclaimer, the term of this patent is extended or adjusted under 35 U.S.C. 154(b) by 949 days.

(21) Appl. No.: 11/390,425

(22) Filed: Mar. 28, 2006

(65) Prior Publication Data

US 2006/0244181 A1 Nov. 2, 2006

(30) Foreign Application Priority Data

Mar. 30, 2005 (DE) ..... 10 2005 014 239

(51) Int. Cl.
*B28B 7/10* (2006.01)

(52) U.S. Cl. ..... 264/336

(58) Field of Classification Search ..... 264/336
See application file for complete search history.

(56) References Cited

U.S. PATENT DOCUMENTS 4,769,191 A * 9/1988 Diana ..... 264/69
5,987,831 A * 11/1999 Lamberts-Van Assche ... 52/316
6,790,544 B2 * 9/2004 Schmitz ..... 428/703
2003/0182011 A1 * 9/2003 Scherer ..... 700/117

FOREIGN PATENT DOCUMENTS

DE 29607260 U1 * 6/1996
EP 409471 A2 * 1/1991

OTHER PUBLICATIONS

Hurd, Mary Krumboltz , ACI Committee 347—Formwork for Concrete Contributor ACI Committee 347—Formwork for Concrete Edition: 7, illustrated Published by American Concrete Institute, 2005 ISBN 0870311778, 9780870311772.*
Derwent Abstract, DE 29607260 U1.*

* cited by examiner

*Primary Examiner*—Christina Johnson
*Assistant Examiner*—Galen Hauth
(74) *Attorney, Agent, or Firm*—Welsh Flaxman & Gitler LLC

(57) ABSTRACT

The invention relates to a method for manufacturing ground slabs from a cement-bonded material or concrete, with a facing made of fine-grade or facing concrete forming the top surface of the respective slab and with a core made of core concrete forming the bottom surface by means of pressing in a mold cavity of a press mold.

19 Claims, 6 Drawing Sheets

METHOD AND MOLD FOR MANUFACTURING GROUND SLABS MADE OF CEMENT-BONDED MATERIAL OR CONCRETE

BACKGROUND OF THE INVENTION

The invention relates to a method and mold for manufacturing ground slabs made of cement-bonded material or concrete.

For the manufacture of ground or pavement slabs made of cement-bonded material, for example concrete, molds are known that consist of a molding frame enclosing a mold cavity on the periphery and of a plate-shaped mold closing element for closing the mold cavity at the bottom which is made for example of hard rubber or a suitable rubber-elastic synthetic material. The molding frame is then fastened for example in an opening of one first machine element of a mold press and the form closing element is fastened in a recess of a second element of the mold press. In order to manufacture the slabs, a fine-grade concrete forming the facing and the top side of the slab is poured into the closed form, followed by a coarse-grade concrete forming the bottom side of the slab, after which the facing and the base are compressed by pressing. After the compression molding of the respective slab, the mold is opened at the bottom by moving the mold element so that the slab can be removed by pushing it downward.

Also known in the art is the processing of concrete slabs manufactured in this manner after hardening of the concrete, e.g. on the top side and on the edge surrounding the top side.

Also known in the art is the manufacture of ground slabs made of concrete with profiling or a side contour on the periphery of the slab, by use of a press mold with a molding frame enclosing a mold cavity, which (frame) is profiled on its inner surface adjacent to the mold cavity to match the side contour. In this known process, a single concrete material is used throughout the process of manufacturing the slabs. There is no forming of a broken or rounded edge surrounding the top side of the slab in this process. The object of the invention is to present a method and a mold for the efficient manufacture of ground slabs with a facing and core with a visually pleasing appearance.

SUMMARY OF THE INVENTION

"Side contour" according to the invention refers to a non-flat shape of the peripheral sides of the ground or pavement slabs, preferably a curved or wavelike and especially an irregularly curved or wavelike structure, however in the manner that the same peripheral shape or the same peripheral structuring is produced in random cross sectional planes parallel to the slab surface, i.e. the raised and recessed areas formed by the side contour are oriented with their longitudinal extension perpendicular to the plane of the slab surface and have a constant cross section in this orientation.

In the same manner, the structuring on the inside of the molding frame forming the side contour is provided over the entire height of the frame, i.e. in the axis direction parallel to the frame axis, so that the molding frame has the same cross section in all cross section planes perpendicular to the frame axis.

"Structured slab surface" according to the invention refers to a surface with a surface structure formed by recesses and/or raised areas. "Structured edge" according to the invention refers to a broken or rounded edge, which in a view of the slab from above for example has a straight or essentially straight or an irregular and/or a singly or multiply curved course in at least a partial area.

BRIEF DESCRIPTION OF THE DRAWINGS

The invention is described below in more detail based on one exemplary embodiment with reference to the drawings, wherein.

DETAILED DESCRIPTION OF THE INVENTION

Figure 2:
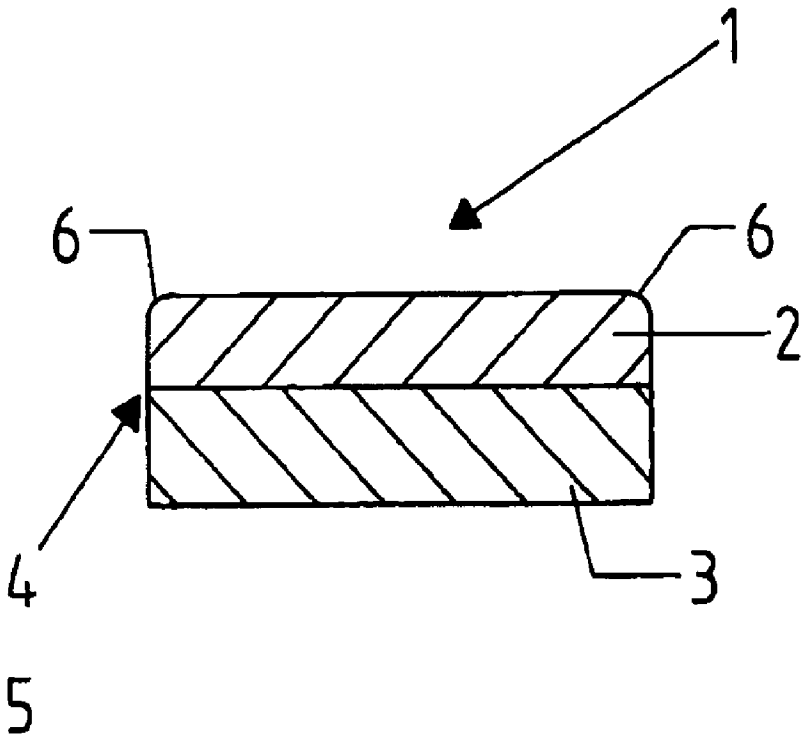
FIGS. 1 and 2 show a simplified depiction in top view and in side view of a slab made of cement-bonded material according to the invention.
Figure 1:
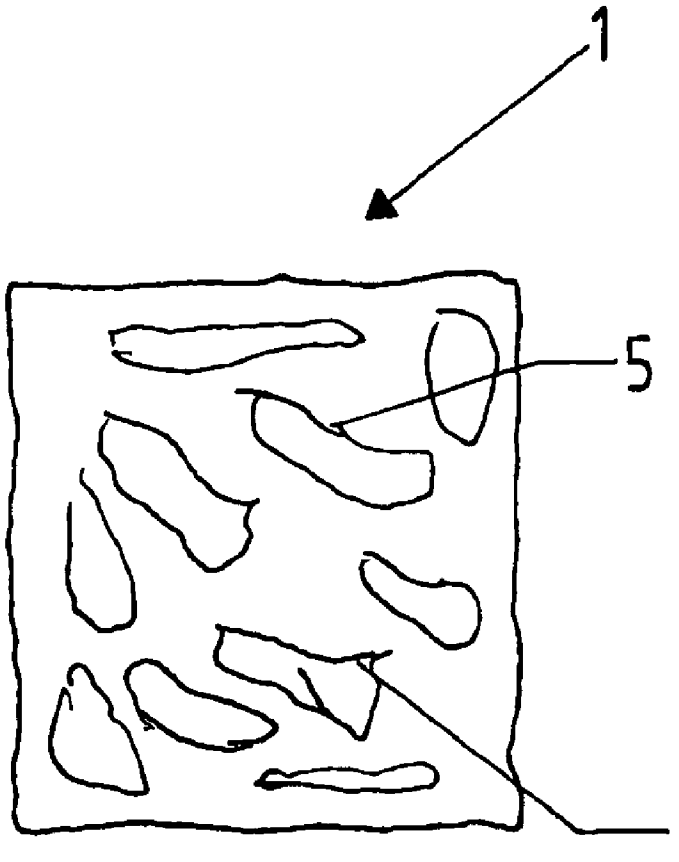

The slabs generally designated 1 in FIGS. 1 and 2 are manufactured from a cement-bonded material, namely with a facing 2 made of a high-quality or fine-grade concrete (facing concrete) forming the top surface of the slab 1 and with a core or base 3 made of a coarser concrete (core concrete) forming the bottom surface of the respective slab 1.

The essentially square slab 1 in the depicted embodiment features on its peripheral sides when viewed from the top a curved side contour 4 and is structured on its top surface 5, i.e. it is provided with raised and recessed areas. Furthermore, the edge 6 surrounding the top side is broken in the cross section plane perpendicular to the top side, i.e. it is rounded and is at the same time irregular, i.e. following the curved peripheral contour, so that the slab 1 presents, at least after laying, a rustic visual appearance corresponding to that of a natural stone slab.

The special characteristic consists in the fact that both the curved peripheral contour 4, the structuring 5 and the rounded and irregular edge 6 are already formed during manufacturing of the slab 1, so that subsequent processing of the slab 1 to produce the structuring 5 and the broken edge 6 is not necessary.

The slab 1 is molded for example on a conventional machine or mold press 7, which is equipped with a rotary table 8 that can turn in cycles on a vertical axis and on which a plurality of molds 9 are distributed at regular angle intervals on the rotation axis.

Each mold 9 consists in the known manner of one molding frame 9.1 inserted in an opening of the rotary table, which (frame) encloses the actual mold cavity 10 on the periphery and the inside surface of which molds the peripheral surface of the respective slab 1, and of a plate-shaped mold closing element or bottom section 11 that closes the bottom of the respective mold 9 and the mold cavity 10 and is designed as a drop base die made for example of a rubber-elastic material, e.g. hard rubber.

The bottom mold section 11 is provided on a machine element 12, which is moved together with the rotary table 7 but which can be lowered onto the rotary table 7 for removing the molded slab manufactured by press molding.

The manufacturing process can be described as follows: first, the facing concrete or fine-grade concrete forming the facing and which has a relatively high water content, is poured into the closed mold 9 in one first working position, after which the core concrete forming the base 3, which has a lower water content than the facing concrete, is poured in a second working position. At least after pouring the core concrete, the concrete is pressed by means of a mold or press die 9.2 in the mold cavity 10 and then, at a further working position, the molded slab thus manufactured is removed after lowering of the closing element 11 and transferred for storage while the concrete sets and hardens.

In order to mold the irregularly curved or wavelike side contour 4, the profiling or structuring 5 of the top slab surface and the rounded or broken edge 6 during manufacturing of the molded slab, the molding frame 9.1 is provided on the inside surface over the entire frame height with a contour corresponding to the side contour 4, extending according to the invention over the entire height of the inside surface of the molding frame, so that the molding frame has the same cross section on its inside surface in all planes oriented perpendicular to the frame axis.

The press die 9.2 of the mold 9 is adapted on its periphery to the inner cross section of the molding frame 10, i.e. the press die 9.2 also has the contour on its outer periphery corresponding to the side contour 4 of the ground slabs 1 to be manufactured.

In order to mold the broken, irregular edge 6, the bottom die 11, as a drop base die, is provided with a trough-shaped recess 15 with an outer edge area 14. The edge forms an even surface 14.1, against which, when the mold 9 is closed, the molding frame 9.1 bears with the full surface of its front side, thus ensuring a tight seal of the mold 9 also at the transition between the molding frame 9.1 and the bottom mold section 11. The surface 14.1 is closed toward the mold cavity 10 by a surface 14.2, which is curved concavely downward toward the bottom 15.1 of the trough-shaped recess 15 corresponding to the shape of the edge 6. The surface 14.2 is also wavelike corresponding to the wave shape of the edge, i.e. it has a changing steepness. Furthermore, the transition between the surfaces 14.1 and 14.2 of the side contour 4 is such that the surface 14.2 graduates at this transition as seamlessly as possible into the inside surface of the molding frame 9.1 forming the side contour 4.

It is essential for the manufacture of the ground slabs 1 and for the auxiliary means used for the manufacture, i.e. the mold 9, the molding frame 9.1 and the press die 9.2, that the shape of the inside surface of the molding frame forming the side contour 4 extends over the entire height of this frame, so that the transition between the surfaces 14.1 and 1.42 exactly follows the course of the side contour 4, that the press die 9.2 is adapted on its peripheral surface to the inside cross section of the molding frame 9.1 and the course of the inside surface of the molding frame 9.1 forming the side contour 4, so that on the one hand the ground slabs 1 are produced in the desired form without disturbing transitions, and on the other hand no residual material remains in the molding frame and in the bottom mold element when removing a molded slab after pressing.

For this reason it is also essential that the contour of the inside surface of the molding frame forming the side contour 4 of the ground slabs 1 extends over the entire height of this frame, so that the respective molded slab is completely pushed out during removal by the press die 9.2 adapted to the inside cross section of this frame and no residual material remains in the molding frame 9.1. It is also essential that the facing concrete with a relatively high water content optimally forms the top surface of the corresponding ground slab 1, but that the subsequently poured core concrete with a lower water content causes excess water from the facing concrete to be absorbed by the core concrete, thus preventing the initially very wet facing concrete from adhering to the bottom mold element 11 with the trough-shaped recess 15.

A further advantage of the depicted embodiment is that the depth of the trough-shaped recess 15 is considerably smaller than the thickness of the manufactured ground slab.

To produce the structuring 5 on the top slab surface, the bottom 15.1 of the trough-shaped recess 15 is provided with complementary profiling or structuring 13.

Figure 3:
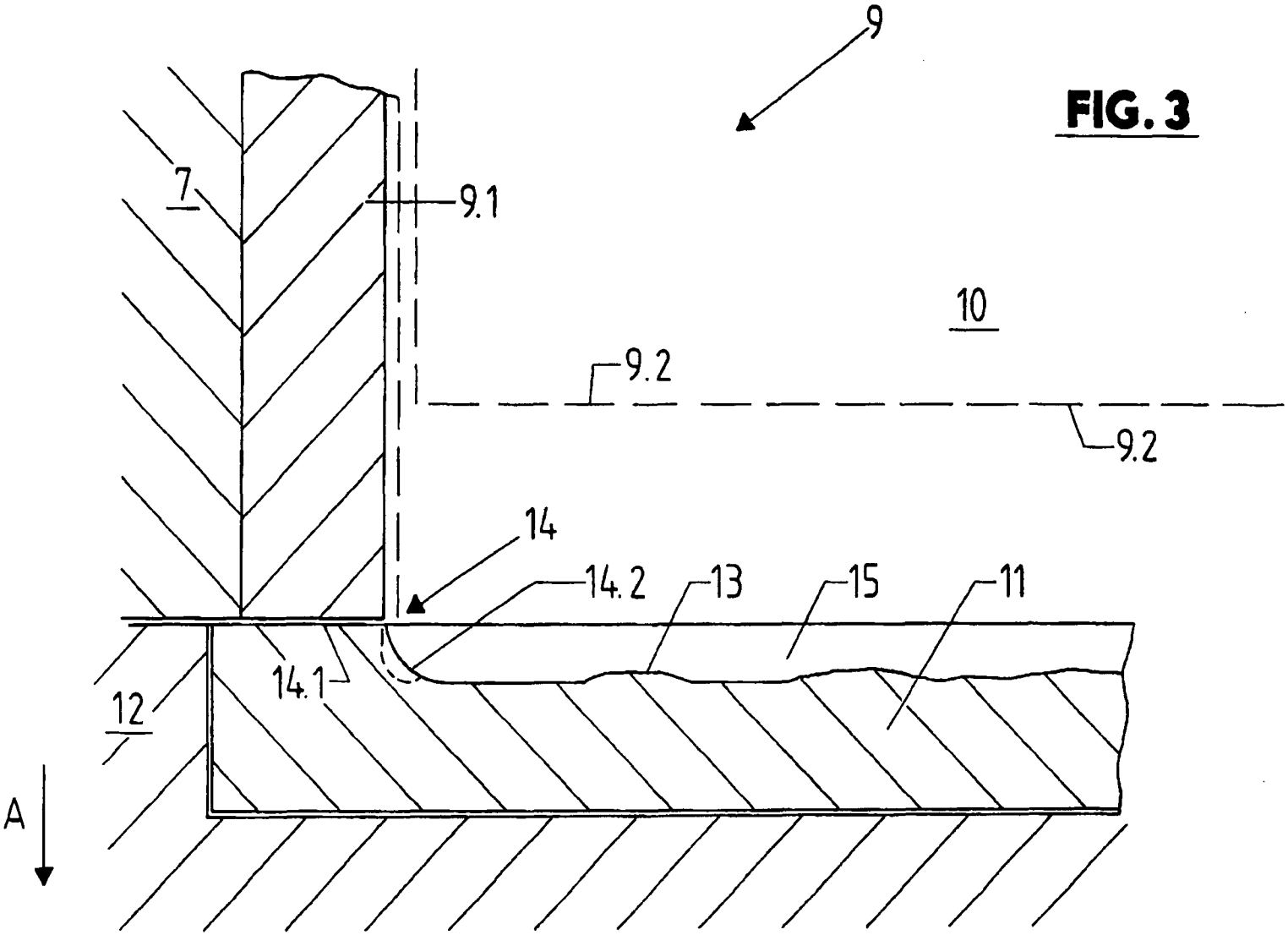
FIG. 3 shows an enlarged view in cross section of the mold for manufacturing the slab in FIGS. 1 and 2.
Figure 4:
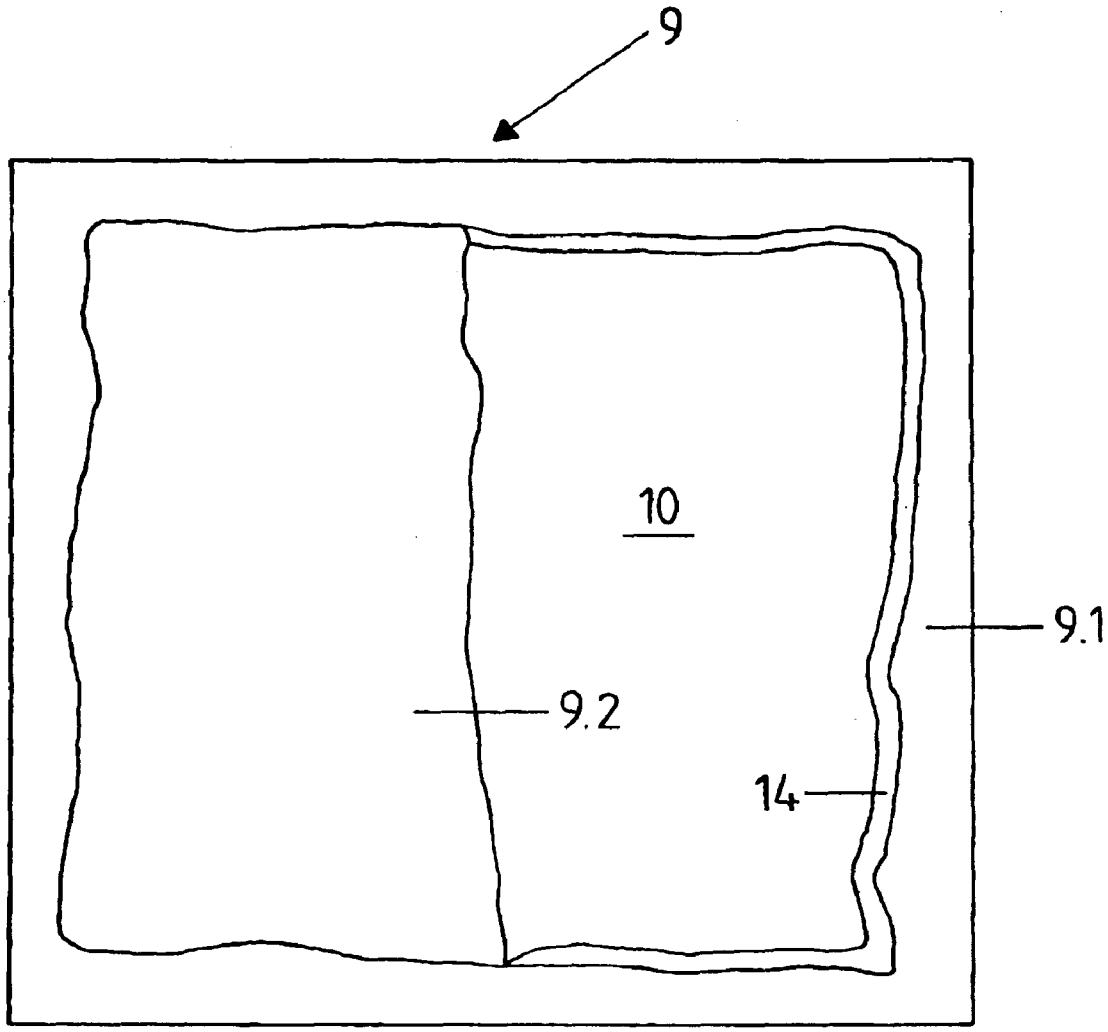
FIG. 4 shows a simplified schematic representation in top view of the mold in FIG. 3.
Figure 5:
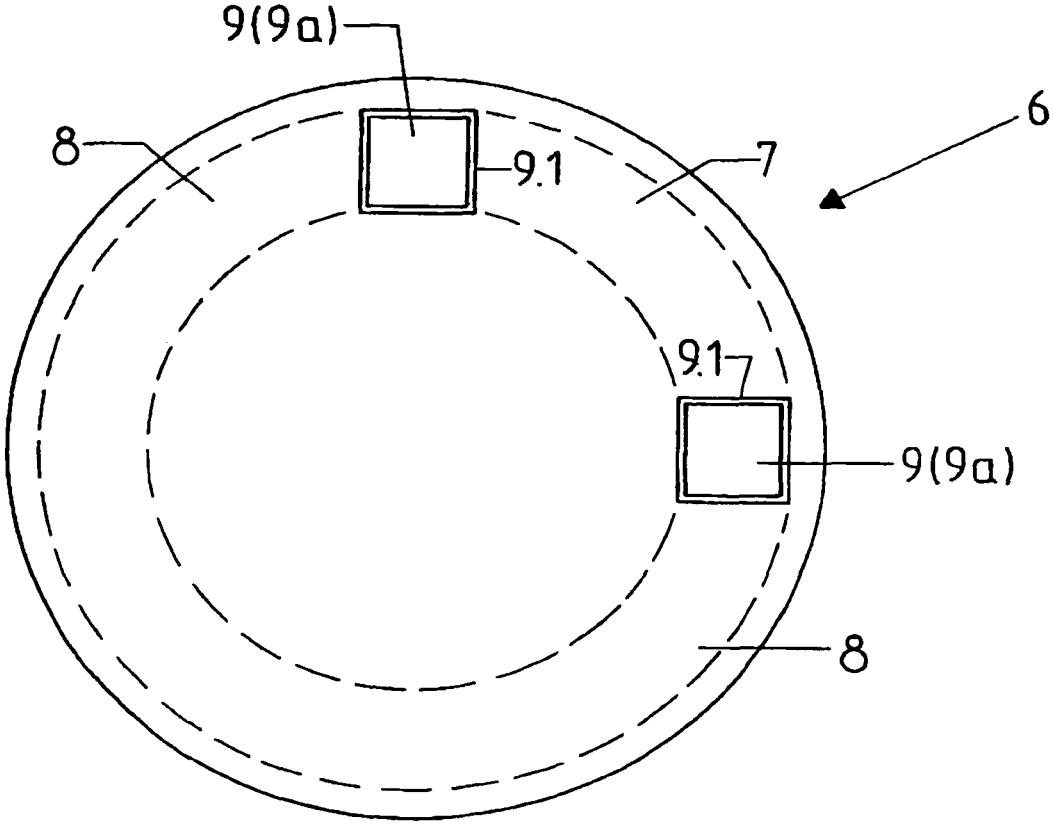
FIG. 5 shows a simplified schematic representation of a press for molding the slabs in FIGS. 1 and 2.
Figure 6:
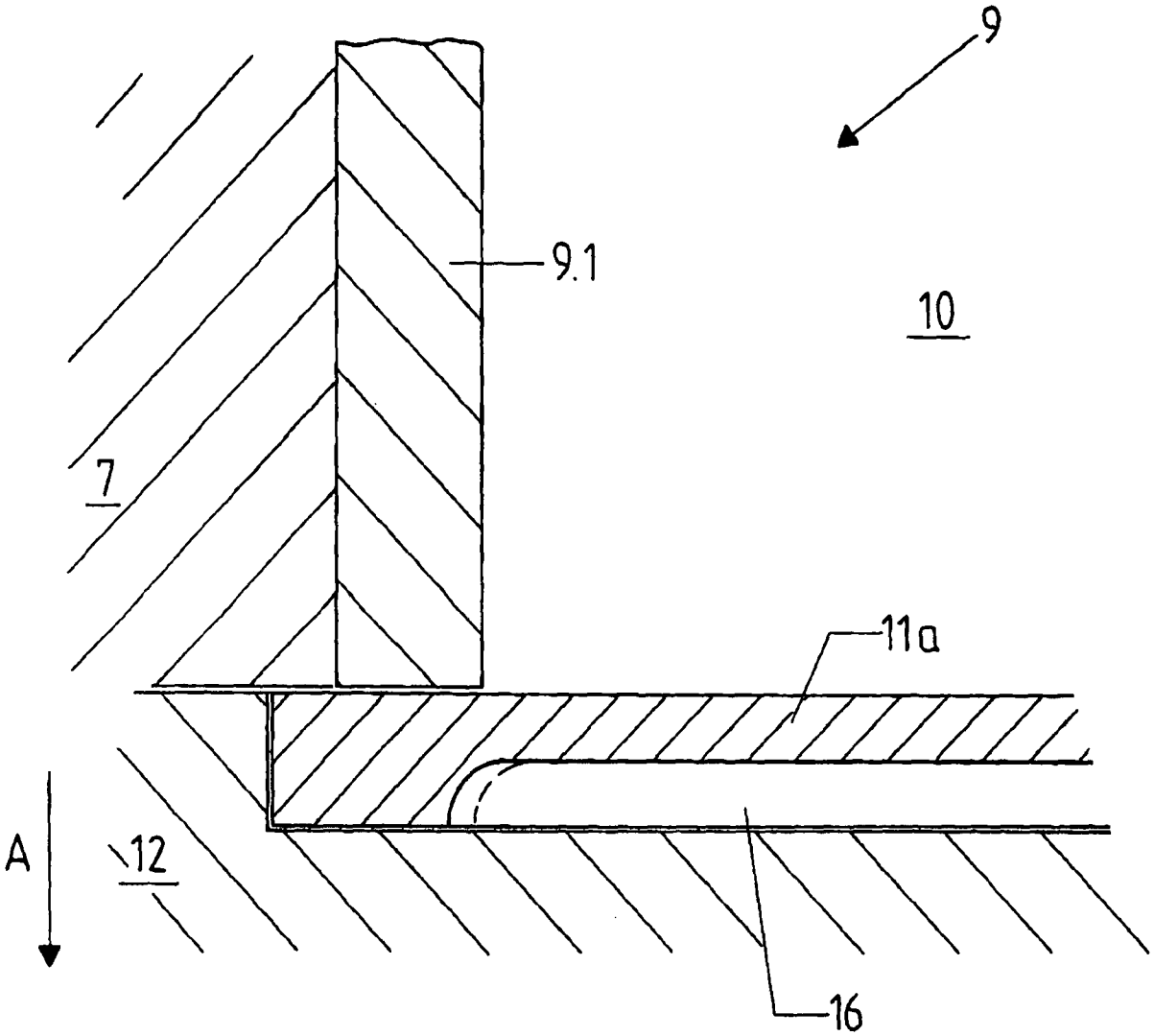
FIG. 6 shows an enlarged partial view in cross section of the mold for manufacturing the slab in FIGS. 1 and 2 in a further embodiment.

FIG. 6 shows in a depiction similar to FIG. 3 as a further possible embodiment a mold 9*a* corresponding to mold 9, in which instead of the drop base die or the bottom mold element 11 a bottom mold element 11*a* is used, which is flat or essentially flat on the top side and has a recess 16 on the bottom corresponding to the recess 15 and is also provided there with profiling 17 corresponding to the profiling 5. During pressing of the molded slab the lower mold element 11*a* is then deformed so that the recess 16 causes the rounded or broken or irregular edge 6 adjoining the side contour 4 to be formed and the profiling 5 through the profiling or projections 17.

One advantage of the mold 9*a* consists in the fact that the lower mold element 11*a* again takes on its flat or level state on the top side after opening of the mold for removal of the molded slab, thus very effectively preventing unwanted adhesion of residual cement on the die or the bottom mold element 11*a*.

It is also possible to fill the recess 15 or 16 with a permanently elastic material, which is softer than the material used for the die or the bottom mold element 11 or 11*a*, so that during pressing, through deformation of the material filling the recess 15 or 16 and in the embodiment of FIG. 6, through deformation of the bottom mold element 11*a* altogether, the irregularly curved or wavelike side or peripheral contour 4, the surface structure 5 and the broken slab edge 6 are formed.

As a result of the structure 13 of the die 11 or 11*a* formed by the raised and recessed areas, the manufactured ground slabs 1 likewise display on their top side the structure 5 formed by the raised and recessed areas.

Figure 7:
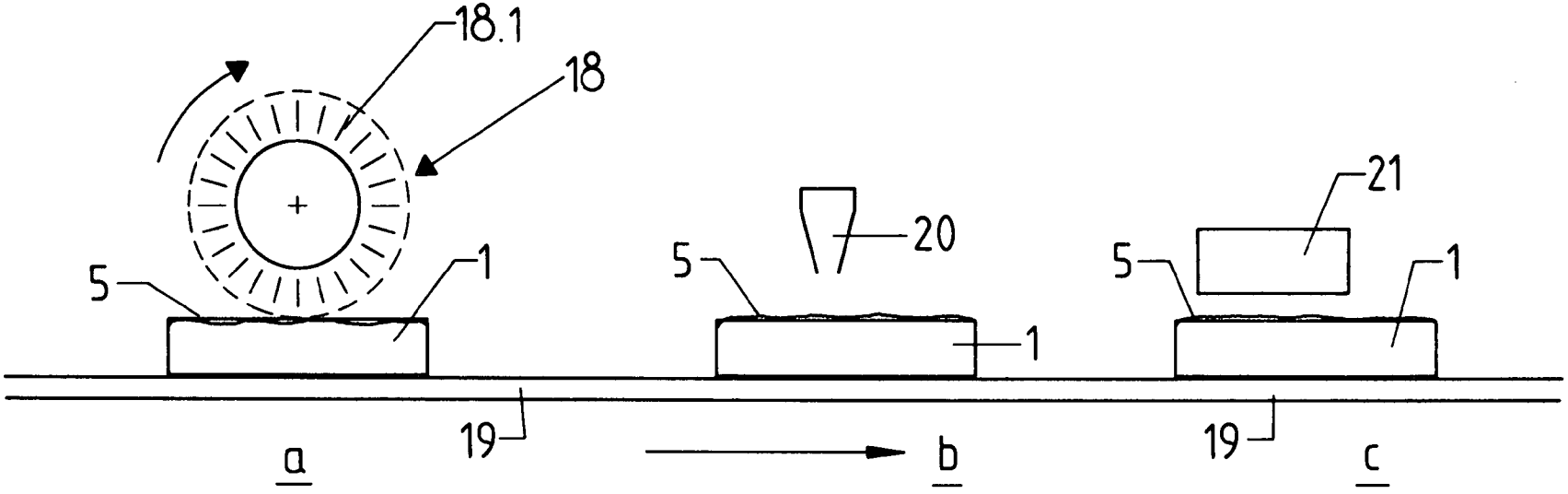
FIG. 7 shows a simplified schematic representation of a system for processing of the ground slabs manufactured with the press or mold in FIGS. 5 and 6.

The ground slabs 1 manufactured using the mold 9 or 9*a* are subjected to further surface processing according to FIG. 7. In one first process step depicted in FIG. 7 in position a, the slabs 1 are brushed by means of a rotating brush, in the depicted embodiment a roller-type brush, on their top surface side provided with the structure or profile 5. The bristles 18.1 of this brush 18 are manufactured on their free ends from a high-strength material or are provided with such a material, for example a diamond coating.

The slabs 1 are moved on a transporter 19 beneath the rotating brush 18. The distance between the brush 18 and the transporter 19 is set so that the ground slabs 1 are processed by the brushes primarily on the raised areas of their structure surface or on the raised areas of the profiling 5 located there, producing a particularly smooth surface on these raised areas that differs significantly from the surface structure of the recessed areas. This alone achieves a special visual appearance of the slabs 1, with smooth raised areas and somewhat rougher recessed areas.

In a further processing step (position b) paint is applied to the top side of the slabs 1, dosed for example by means of a spray nozzle 20. Paint is used that hardens from exposure to the UV light of a UV radiation source in a subsequent processing step (position c of FIG. 7) after penetrating the surface of the respective slab. The application of paint closes in particular the pores in the non-brushed recessed areas of the surface structure, thus sealing the surface and preventing the accumulation of dirt and/or the penetration of liquids into the respective slab and therefore preventing any resulting negative effect on the visual appearance of the slab. The previous brushing of the slabs and the ensuing reduction of the surface roughness in raised areas furthermore significantly reduces the quantity of paint required.

The invention was described above based on exemplary embodiments. It goes without saying that numerous modifications and variations are possible.

It was assumed in the above description that the brushing of the slabs 1 takes place by means of a roller-type rotary driven brush 18. Of course, other designs are also possible, in particular such designs with one or more brushes with bristles on the front side of a disk-shaped brush body that are rotary driven on an axis perpendicular to the face of the disk-shaped brush body. Other forms and drives for brushes are conceivable, in particular brushes that not only rotate but also are simultaneously pivoted or moved in another manner.

REFERENCE LIST

1 ground or pavement slab
2 facing
3 base
4 side contour
5 structuring on the top face of slab
6 rounded and irregular edge
7 press
8 rotary table
9, 9*a* mold
9.1 molding frame
9.2 die
10 mold cavity
11, 11*a* die or plate-shaped bottom mold element
12 lowerable element of rotary table 7
13 structuring
14 peripheral edge
14.1, 14.2 surface
15 trough-shaped recess
16 recess
17 structuring
18 brush
18.1 bristles
19 transporter
20 nozzle for applying paint
21 UV light source
A lowering movement of mold element 11 or 11*a*

What is claimed is:

1. A method for manufacturing ground or pavement slabs from cement-bonded material or concrete with a facing made of fine-grade or facing concrete forming the top surface of the respective ground slab and with a core made of cement-bound core concrete forming the bottom surface by pressing in a mold cavity of a press mold, which comprises:

(i) a die closing the mold cavity at the bottom, (ii) a molding frame limiting the mold cavity on one periphery and pressing tightly against one edge of the die, and (iii) a press die that can be inserted into the molding frame from the top side of the latter, the method comprising the steps of:

first pouring the facing concrete forming the top surface into the mold cavity, after that pouring the core concrete forming the core into the mold cavity, with the core concrete having a water content smaller than the water content of the facing concrete, pressing the facing concrete and the core concrete in the mold cavity by means of the press die, using a molding frame, the inside surface of which limits the mold cavity and is provided over the entire height with continuous structuring for forming a wavelike or irregularly formed side contour of each of the peripheral sides of the manufactured ground slabs, using a die which is a drop base die for molding a structured or broken edge adjoining the side contour of the manufactured ground slab with a die edge area enclosing a trough-shaped recess and forming the structured or broken slab edge with an irregular edge profile, which when the press mold is closed transitions seamlessly or nearly seamlessly into the structured inside surface of the molding frame, with a distance of the level of the edge of the drop base die from the level of lowest point of the drop base die being at least 3-5 mm, and using a press die which is adapted on its periphery to the course of the inside surface or structuring of the molding frame forming the side contour, the slabs being formed on their top side with profiling or structuring featuring raised and recessed areas and being processed on the structured top surface after molding and setting of the concrete so that the raised areas of the profiling have a different surface structure than the recessed areas of the profiling.

2. The method according to claim 1, wherein the ground slabs after molding and setting of the concrete are treated at least on their top surface with a liquid, hardening material, a material that closes the pores of the ground slabs.

3. The method according to claim 1, wherein the die is made of a rubber-elastic material.

4. The method according to claim 1, wherein the use of a drop base die, in which the depth of the trough-shaped recess is smaller than the thickness of the manufactured ground slabs.

5. The method according to claim 4, wherein the drop base die is used as a lower mold element, the depth of which is no more than ⅓ the thickness of the manufactured ground slabs.

6. The method according to claim 1, wherein the die is used features on its side facing the mold cavity structuring for forming profiling or structuring on the top surface of the manufactured ground slabs.

7. The method according to claim 1, wherein the ground slabs are processed during brushing only or on the raised areas of the structuring.

8. The method according to claim 1, wherein the ground slabs after molding and setting of the concrete are treated with a plastic or paint that hardens through exposure to UV light.

9. The method according to claim 1, wherein the surface treatment takes place after brushing of the ground slabs.

10. A method for manufacturing ground or pavement slabs from cement-bound concrete with a facing made of cement-bound fine-grade or facing concrete forming the top surface of the respective ground slab and with a core made of cement-bound core concrete forming the bottom surface by pressing in a mold cavity of a press mold, which comprises:

(i) a die closing the mold cavity at the bottom, (ii) a molding frame limiting the mold cavity on one periphery and pressing tightly against one edge of the die, and (iii) a press die that can be inserted into the molding frame from the top side of the latter, the method comprising: first pouring the facing concrete forming the top surface into the mold cavity, after that pouring the core concrete forming the core into the mold cavity, with the core concrete having a water content smaller than the water content of the facing concrete, pressing the facing concrete and the core concrete in the mold cavity by means of the press die, using a molding frame, the inside surface of which limits the mold cavity and is provided over the entire height with continuous structuring for forming a wavelike or irregularly formed side contour of each of the peripheral sides of the manufactured ground slabs, using a die which is a drop base die for molding a structured or broken edge adjoining the side contour of the manufactured ground slab with a die edge area enclosing a trough-shaped recess and forming the structured or broken slab edge with an irregular edge profile, which when the press mold is closed transitions seamlessly or nearly seamlessly into the structured inside surface of the molding frame, with a distance of the level of the edge of the drop base die from the level of lowest point of the drop base die being at least 3-5 mm, and using a press die which is adapted on its periphery to the course of the inside surface or structuring of the molding frame forming the side contour, the slabs being formed on their top side with profiling or structuring featuring raised and recessed areas and after molding and after setting of the concrete the slabs being treated at least on their top surface with a liquid hardening material that closes the pores of the slabs.

11. The method according to claim 10, wherein the slabs are formed on their top side with profiling or structuring featuring raised and recessed areas and are processed on the structured top surface after molding and setting of the concrete so that the raised areas of the profiling have a different surface structure than the recessed areas of the profiling.

12. The method according to claim 10, wherein the die is made of a rubber-elastic material.

13. The method according to claim 10, wherein the drop base die, in which the depth of the trough-shaped recess is smaller than the thickness of the manufactured ground slabs.

14. The method according to claim 13, wherein the drop base die is used as a lower mold element, the depth of which is no more than ⅓ the thickness of the manufactured ground slabs.

15. The method according to claim 10, wherein the die, comprises on its side facing the mold cavity structuring for forming profiling or structuring on the top surface of the manufactured ground slabs.

16. The method according to claim 10, wherein the ground slabs are processed during brushing only or on the raised areas of the structuring.

17. The method according to claim 10, wherein the ground slabs after molding and setting of the concrete are treated with a plastic or paint that hardens through exposure to UV light.

18. The method according to claim 10, wherein the surface treatment takes place after brushing of the ground slabs.

19. A method for manufacturing ground or pavement slabs from cement-bonded material or concrete with a facing made of fine-grade or facing concrete forming the top surface of the respective ground slab and with a core made of cement-bound core concrete forming the bottom surface by pressing in a mold cavity of a press mold, which comprises:

(i) a die closing the mold cavity at the bottom, (ii) a molding frame limiting the mold cavity on one periphery and pressing tightly against one edge of the die, and (iii) a press die that can be inserted into the molding frame from the top side of the latter, the method comprising the steps of: first pouring the facing concrete forming the top surface into the mold cavity, after that pouring the core concrete forming the core into the mold cavity, with the core concrete having a water content smaller than the water content of the facing concrete, pressing the facing concrete and the core concrete in the mold cavity by means of the press die, using a molding frame, the inside surface of which limits the mold cavity and is provided over the entire height with continuous structuring for forming a wavelike or irregularly formed side contour of each of the peripheral sides of the manufactured ground slabs, using a die which is a drop base die for molding a structured or broken edge adjoining the side contour of the manufactured ground slab with a die edge area enclosing a trough-shaped recess and forming the structured or broken slab edge with an irregular edge profile, which when the press mold is closed transitions seamlessly or nearly seamlessly into the structured inside surface of the molding frame, with a distance of the level of the edge of the drop base die from the level of lowest point of the drop base die being at least 3-5 mm., and using a press die which is adapted on its periphery to the course of the inside surface or structuring of the molding frame forming the side contour, the slabs being formed on their top side with profiling or structuring featuring raised and recessed areas and being processed on the structured top surface after molding and setting of the concrete so that the raised areas of the profiling have a different surface structure than the recessed areas of the profiling, and after setting of the concrete the slabs being treated at least on their top surface with a liquid hardening material that closes the pores of the slabs with a distance of the level of the edge of the drop base die from the level of lowest point of the drop base die being at least 3-5 mm.

* * * * *